US010386880B2

(12) United States Patent
Antunes Ribafeita et al.

(10) Patent No.: US 10,386,880 B2
(45) **Date of Patent: *Aug. 20, 2019**

(54) CIRCUIT ARRANGEMENT FOR COMPENSATING CURRENT VARIATIONS IN CURRENT MIRROR CIRCUIT

(71) Applicant: Skyworks Solutions, Inc., Woburn, MA (US)

(72) Inventors: Rui Filipe Antunes Ribafeita, Lawrenceville, GA (US); Michael Wayne Trippe, Norcross, GA (US)

(73) Assignee: Skyworks Solutions, Inc., Woburn, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/132,200

(22) Filed: Sep. 14, 2018

(65) Prior Publication Data

US 2019/0121382 A1 Apr. 25, 2019

Related U.S. Application Data

(63) Continuation of application No. 13/789,908, filed on Mar. 8, 2013, now Pat. No. 10,095,259.

(51) Int. Cl.
*G05F 3/16* (2006.01)
*G05F 3/26* (2006.01)

(52) U.S. Cl.
CPC ..... *G05F 3/16* (2013.01); *G05F 3/265* (2013.01); *G05F 3/267* (2013.01)

(58) Field of Classification Search
CPC ..... G05F 3/267
USPC ..... 307/304; 323/312, 313, 317; 327/538, 327/543
See application file for complete search history.

(56) References Cited

U.S. PATENT DOCUMENTS

| | | | | |
|---|---|---|---|---|
| 6,784,702 | B1 * | 8/2004 | Chen | G05F 3/265 327/110 |
| 7,795,954 | B2 * | 9/2010 | Vice | G05F 3/262 323/312 |
| 2004/0257149 | A1 * | 12/2004 | Baskett | G05F 3/265 327/538 |
| 2006/0125461 | A1 * | 6/2006 | Nakata | G05F 3/222 323/313 |

* cited by examiner

*Primary Examiner* — Gary A Nash
(74) *Attorney, Agent, or Firm* — Knobbe, Martens, Olson & Bear LLP

(57) ABSTRACT

An electronic current mirror circuit particularly suitable for use in radio frequency (RF) and microwave power amplifiers. The electronic circuit includes a first current mirror circuit and a second current mirror circuit. The first current mirror circuit includes a first input circuit path and a first output circuit path, the first input circuit path is operated at a first supply voltage and the first output circuit path is operated at a second supply voltage. The second current mirror circuit includes a second input circuit path and a second output circuit path, the second input circuit path is operated at the second supply voltage, and the second output circuit path is connected to the first input circuit path so that variations in a current through the first output circuit path are compensated by a current in the second output circuit path.

20 Claims, 2 Drawing Sheets

CIRCUIT ARRANGEMENT FOR COMPENSATING CURRENT VARIATIONS IN CURRENT MIRROR CIRCUIT

RELATED APPLICATION

This application is a continuation of U.S. Application Ser. No. 13/789,908, filed on Mar. 8, 2013 and titled "CIRCUIT ARRANGMENT FOR COMPENSATING CURRENT VARIATIONS IN CURRENT MIRROR CIRCUIT", which is hereby incorporated by reference in its entirety herein. Any and all applications, if any, for which a foreign or domestic priority claim is identified in the Application Data Sheet of the present application are hereby incorporated by reference in their entireties under 37 CFR 1.57.

TECHNICAL FIELD

The present invention generally relates to current mirror circuits. More specifically, the present invention relates to a circuit arrangement for compensating variations in the current of the current mirror circuit.

BACKGROUND OF THE INVENTION

Radio frequency (RF) and microwave power amplifiers are used in the field of communication as they generate relatively high amounts of power that is useful in wireless communication systems. These RF and microwave power amplifiers are biased with various types of circuits. A well known type of circuit used for biasing is a current mirror circuit. In a typical current mirror circuit, an output current follows, or mirrors, the input current, or is a proportionate multiple of the input current. However, inherent problems such as changes in supply voltage, ambient temperature variations, and manufacturing variations prevent the output current from accurately mirroring the input current. Furthermore, in many RF and Microwave power amplifiers the bias point of the transistors shift as the supply voltage varies due to the "Early voltage effect".

The Early voltage effect is a variation in an effective width of the base region of the transistor due to a variation in the supply voltage (the collector voltage) across the base-to-collector terminal of the transistor. When biased, the effective width of the base region is less than the actual width of the base region in the transistor due to the presence of depletion regions at one or more of the emitter-base junction and the base-collector junction. Thus, when the collector voltage increases the area of the depletion region also increases resulting in increased current gain. In the current mirror circuit, current ratios across mirroring transistors are based on areas of the mirroring transistors. However, due to the Early voltage effect, with an increase in the supply voltage at the collector terminals, the current across the collector terminals of the mirroring transistors increases. This increase causes errors in the current ratios across the mirroring transistors in the current mirror circuit. Although current mirror circuits are a standard part of most analog integrated circuits, the standard current mirror circuit configurations do not address the need for collector supply voltage compensation of RF power amplifiers.

In view of the foregoing, a compensating current mirror circuit that is adaptive to the Early voltage effect, variations in supply voltage, ambient temperature changes, and tolerant to manufacturing variations is desirable.

SUMMARY OF THE INVENTION

According to embodiments illustrated herein, there is provided an electronic circuit. The electronic circuit includes a first current mirror circuit and a second current mirror circuit. The first current mirror circuit includes a first input transistor and a first output transistor, in which a collector terminal of the first input transistor is connected to a first voltage source through a first resistor, a collector terminal of the first output transistor is connected to a second voltage source, the emitter terminals of the first input transistor and the first output transistor are grounded, and a base terminal of the first input transistor is connected to a base terminal of the first output transistor. The second current mirror circuit includes a second input transistor and a second output transistor, in which a collector terminal of the second input transistor is connected to the second voltage source through a second resistor, a collector terminal of the second output transistor is connected to the collector terminal of the first input transistor through the first resistor, the emitter terminals of the second input transistor and the second output transistor are grounded, and a base terminal of the second input transistor is connected to a base terminal of the second output transistor.

The electronic circuit further includes a current control transistor, in which the source terminal of the current control transistor is connected to the collector terminal of the first input transistor through the first resistor. The gate terminal of the current control transistor is connected to the collector terminal of the first input transistor. The drain terminal of the current control transistor is connected to the first voltage source. The electronic circuit also includes an error transistor, wherein the base terminal of the error transistor is connected to the source terminal of the current control transistor, the collector terminal of the error transistor is connected to the second voltage source, and a emitter terminal of the error transistor is connected to the base terminals of the first input transistor and the first output transistor.

The second current mirror circuit compensates for variations in the second supply voltage by drawing out a compensating current from the first current mirror circuit. The magnitude of the compensating current depends on the values of the first resistor and the second resistor. Thus, different values of the first resistor and the second resistor result in compensating variations in the collector current across the first output transistor.

The current source transistor and the first resistor are combined to form a current source configuration. The current source configuration provides a reference current to the current mirror base network that maintains the proper bias point and operating conditions in the current mirror circuit, which is useful for associated circuits such as RF and microwave power amplifiers. Further, the combination of the current source transistor and the first impedance element minimizes the variations in the current flowing through the current source transistor facilitating more stable operation. Thus, associated circuits which include the second current mirror circuit, and the current source configuration in the first current mirror circuit operate under more stable conditions.

BRIEF DESCRIPTION OF THE DRAWINGS

The detailed description of the embodiments of the invention will hereinafter be described in conjunction with the appended drawings provided to illustrate and not to limit the invention, wherein like designations denote like elements, and in which.

DESCRIPTION OF THE PREFERRED EMBODIMENTS

The invention can be best understood with reference to the detailed figures and description set forth herein. Various embodiments are discussed below with reference to the figures. However, those of ordinary skill in the art will readily appreciate that the detailed description given herein with respect to these figures is just for explanatory purposes. The disclosed systems extend beyond the described embodiments. For example, those of ordinary skill in the art will appreciate that in light of the teachings presented, multiple alternate and suitable approaches may be realized, to implement the functionality of any detail described herein, beyond the particular implementation choices in the following embodiments described and shown.

Figure 1:
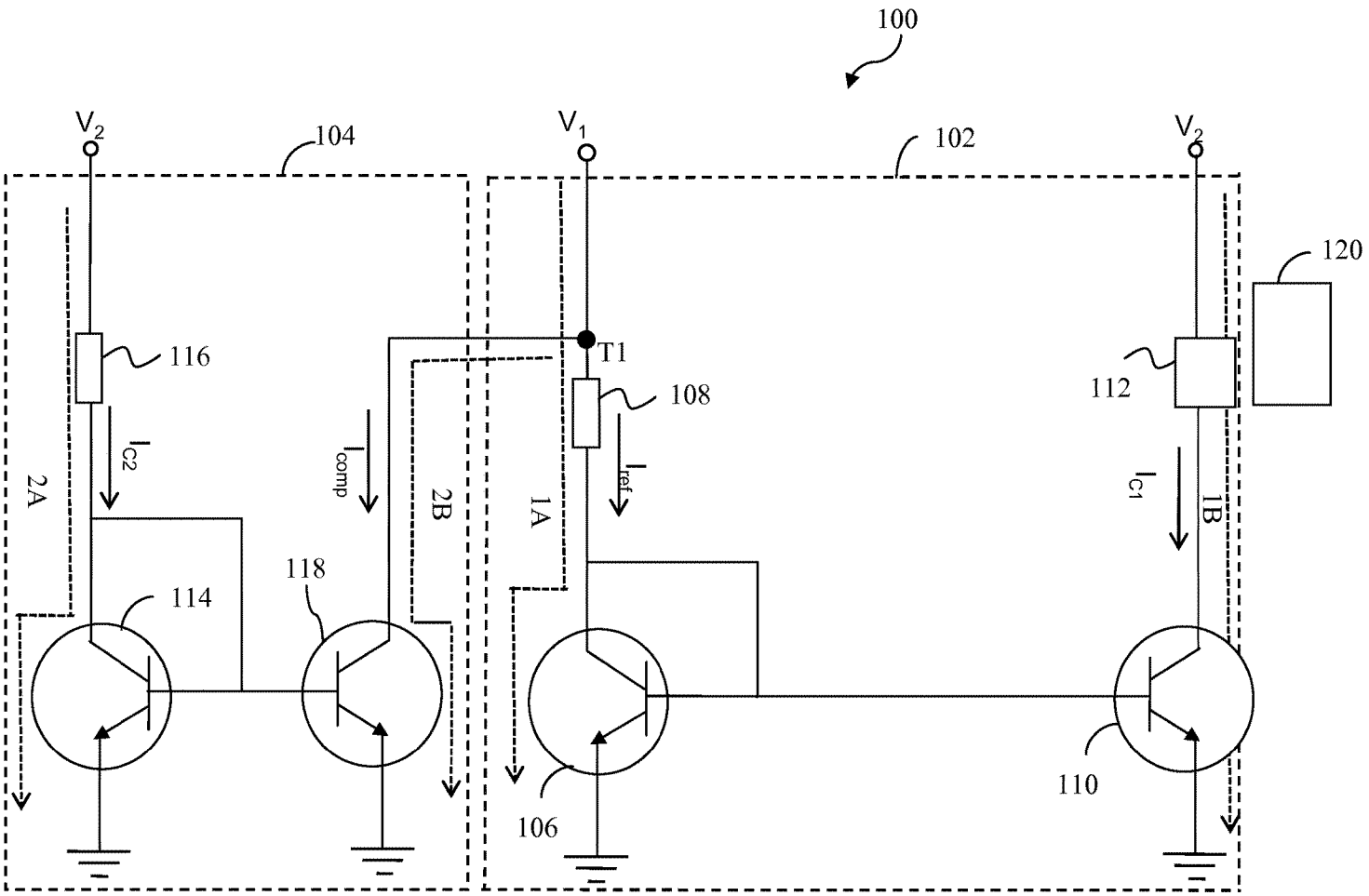
FIG. 1 illustrates an electronic circuit in accordance with an embodiment of the invention.

FIG. 1 illustrates an electronic circuit 100 in accordance with an embodiment of the invention. Electronic circuit 100 includes a first current mirror circuit 102 and a second current mirror circuit 104. First current mirror circuit 102 includes a first input circuit path 1A and a first output circuit path 1B. Second current mirror circuit 104 includes a second input circuit path 2A and a second output circuit path 2B. Second current mirror circuit 104 is connected to the first input circuit path 1A at a terminal T1.

The first input circuit path 1A includes a first input transistor 106 with its collector terminal connected to a first voltage source supplying a first supply voltage $V_1$ through a first resistor 108. The emitter terminal of first input transistor 106 is grounded. The first output circuit path 1B includes a first output transistor 110 with its collector terminal connected to a second voltage source supplying a second supply voltage $V_2$ through an inductive element 112. The emitter terminal of first output transistor 110 is grounded. The base terminals of first input transistor 106 and first output transistor 110 are connected.

The second input circuit path 2A includes a second input transistor 114 with its collector terminal connected to second voltage source $V_2$ through a second resistor 116. The emitter terminal of second input transistor 114 is grounded. The second output circuit path 2B comprises a second output transistor 118 with its collector terminal connected to the collector terminal of first input transistor 106. The emitter terminal of second output transistor 118 is grounded. The base terminals of second input transistor 114 and second output transistor 118 are connected.

Various examples of first input transistor 106, first output transistor 110, second input transistor 114, and second output transistor 118 include, but are not limited to, a Bipolar Junction Transistor (BJT) such as a Hetero-junction Bipolar Transistor (HBT). The inductive element 112 can be an inductor. The first and second voltage sources can be any Direct Current (DC) voltage sources such as batteries.

In the embodiment, a reference current $I_{ref}$ flowing through the first input circuit path 1A biases first input transistor 106 to a desired operating point. It will be apparent to a person having ordinary skill in the art that as first input transistor 106 and first output transistor 110 have the same base-emitter voltage, they will be biased to a same relative operating point. Thus, in the first current mirror circuit 102 the base currents and the voltage across the base terminals of first input transistor 106 and first output transistor 110 are held constant. For example, the first supply voltage $V_1$ is usually low for first input transistor 106. Conversely, any RF output device connected to first output transistor 110 may be operated at a much higher value of supply voltage (the second supply voltage $V_2$).

Since the second input circuit path 2A is also connected to the second voltage source, any change in the second supply voltage $V_2$ is observed at second input transistor 114, thus causing a corresponding change in the collector current $I_{C2}$ of second input transistor 114. As this current is mirrored in the second output circuit path 2B, there is a proportional change in the collector current $I_{comp}$ of second output transistor 118. As shown in FIG. 1, since the collector terminal is connected to the first input circuit path 1A, this collector current $I_{comp}$ (compensation current) is drawn from the reference current $I_{ref}$ of the first input circuit path 1A. Thus, second current mirror circuit 104 ensures the collector current $I_{C1}$ at first output transistor 110 remains constant even when the second supply voltage $V_2$ changes, by compensating the current across the first output circuit path 1B with a proportional current across the second output circuit path 2B. In an embodiment, the amount of compensation depends on the area ratios of second input transistor 114 and second output transistor 118 as well as the choice of first resistor 108 and second resistor 116. For example only, the area ratio of second input transistor 114 and second output transistor is in the range of 1 to 100.

Figure 2:
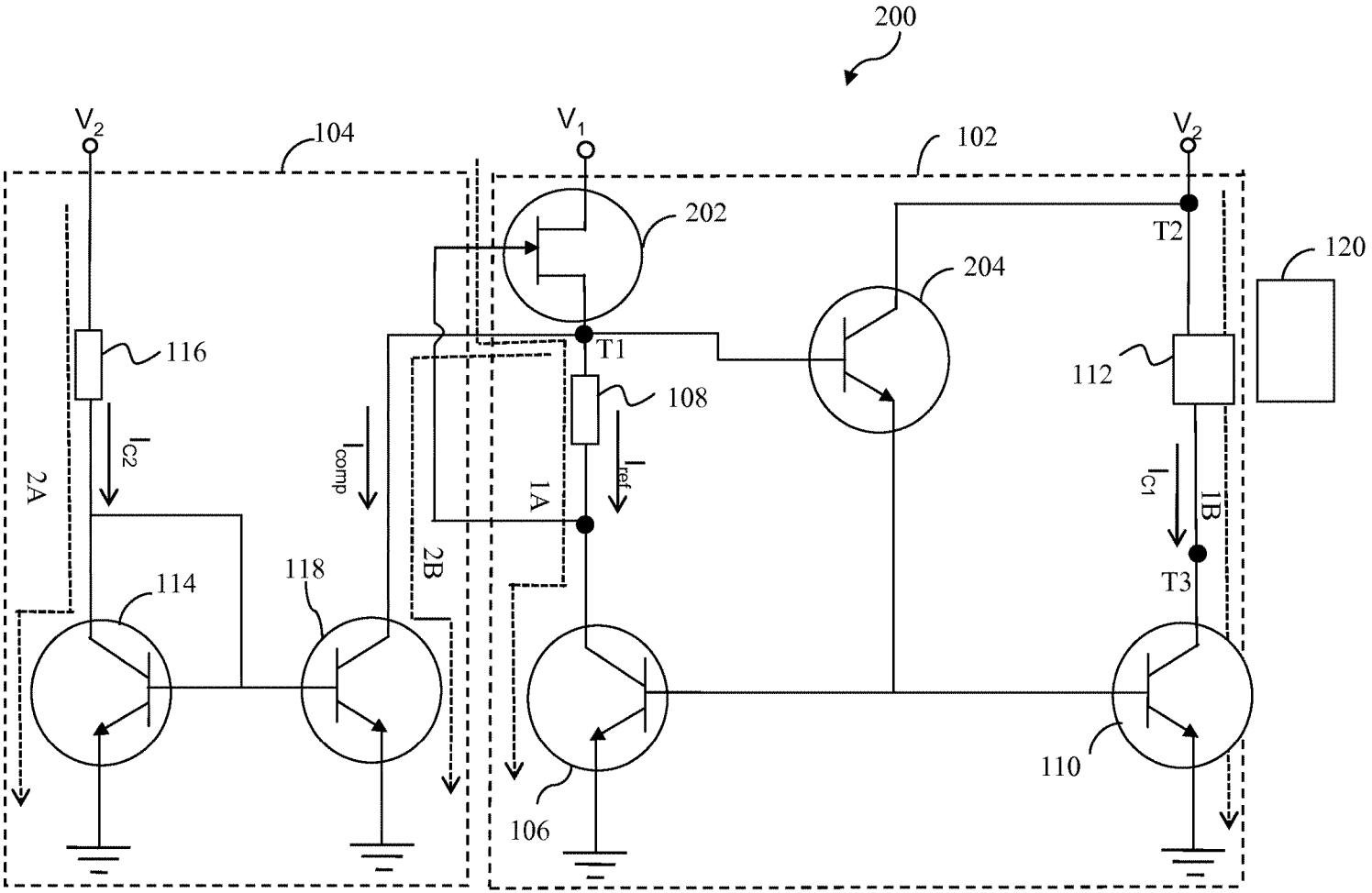
FIG. 2 illustrates another electronic circuit in accordance with an embodiment of the invention.

FIG. 2 illustrates an electronic circuit 200 in accordance with another embodiment of the invention. Electronic circuit 200 includes the first current mirror circuit 102 with additional electronic components and second current mirror circuit 104. The elements referenced with same numbers in FIG. 2 as that of the electronic circuit 100 are connected in similar fashion as explained in FIG. 1.

The first current mirror circuit 102 additionally includes a current control transistor 202 and an error transistor 204. Current control transistor 202 is connected in the first input circuit path 1A. The drain terminal of current control transistor 202 is connected to the first supply voltage $V_1$ that is capable of driving current control transistor 202. The source terminal of current control transistor 202 is connected to the collector terminal of first input transistor 106 through first resistor 108. The gate terminal of current control transistor 202 is connected to the collector terminal of first input transistor 106.

The emitter terminal of error transistor 204 is connected to the base terminals of first input transistor 106 and first output transistor 110. The base terminal of error transistor 204 is connected to the source terminal of current control transistor 202. The collector terminal of error transistor 204 is connected to the first output circuit path 1B at a terminal T2.

Current control transistor 202 together with first resistor 108 forms a current source configuration in the first input circuit path 1A. The current source configuration provides the reference current $I_{ref}$ to first input transistor 106. First resistor 108 provides a negative feedback signal to current control transistor 202. This negates any variations in the reference current $I_{ref}$ flowing through current control transistor 202. The variations in the reference current $I_{ref}$ may arise due to temperature variations and manufacturing variations of current control transistor 202. The current source configuration, thus, provides constant reference current $I_{ref}$ to first input transistor 106. In this embodiment, current control transistor 202 is operated at near the pinch off voltage which increases the depletion region of current source transistor 202. At near pinch off voltage only a small current required for biasing first input transistor 106, passes from the drain terminal to the source terminal of current control transistor 202. The U.S. patent application entitled, "IMPROVED CURRENT MIRROR CIRCUIT", application Ser. No. 13/724,256, filed Dec. 21, 2012, and assigned to the same assignee (ANADIGICS INC), and which is herein incorporated by reference in its entirety, discloses the current mirror circuit comprising the current source configuration.

Error transistor 204 converts the voltage at the source terminal of current control transistor 202 to an error signal, and completes the feedback loop around the base terminal of first input transistor 106. In addition, error transistor 204 operates as an emitter follower and does not perturb the constant reference current $I_{ref}$. Furthermore, error transistor 204 provides a high drive current to the base terminal of first output transistor 110 due to its low output impedance.

An example of current control transistor 202 includes, but is not limited to, a depletion mode Field Effect Transistor (FET). An example of error transistor 204 includes, but is not limited to, a Bipolar Junction Transistor (BJT) such as a Hetero-junction Bipolar Transistor (HBT).

In this embodiment, the reference current $I_{ref}$ biases first input transistor 106 to a desired operating point. As discussed earlier under FIG. 1, that as first input transistor 106 and first output transistor 110 has the same base-emitter voltages, they will be biased to a same relative operating point. However, in normal RF circuits that use current mirror circuits, such as electronic circuit 200, the collector current $I_{C1}$ across first output transistor 110 has to be high. In contrast, first input transistor 106 should consume the least possible current since first input transistor 106 is only meant for biasing electronic circuit 200. This is achieved by the differential emitter areas of first input transistor 106 and first output transistor 110. In electronic circuit 200, the emitter area of first output transistor 110 may typically range from 10 to 1000 times of the emitter area of first input transistor 106 and more preferably 100 to 1000 times. In an exemplary embodiment, the emitter area of first output transistor 110 is 3600 $\mu m^2$, and the emitter area of first input transistor 106 is 10 $\mu m^2$. It will be apparent to a person having ordinary skill in the art with this arrangement of first input transistor 106 and first output transistor 110, the current across first input transistor 106 is mirrored across first output transistor 110. However, due to the differential emitter areas of first input transistor 106 and first output transistor 110, the current density or the current ratio across first input transistor 106 and first output transistor 110 is not proportional. The current density of first output transistor 110 is made proportional by providing error transistor 204, which acts as a current booster by providing high drive current at the base terminal of first output transistor 110. The high base current thus available across first output transistor 110 is useful for the high RF drive of RF and microwave power amplifiers. In an embodiment, for example, the power amplifier output is produced at a terminal T3 as shown in the FIG. 2.

In this embodiment, the collector voltage across first output transistor 110 varies due to the Early voltage effect in electronic circuits (100 and 200). This leads to error in the current ratios across first input transistor 106 and first output transistor 110 resulting in a variable base current (instead of a fixed base current) across first output transistor 110. For example, the collector voltage across first input transistor 106 may be less than or equal to 1V and the collector voltage across first output transistor 110 may vary from 3.0 to 5.0 V. Second current mirror circuit 104 compensates the variations in the base current across first output transistor 110 by drawing out compensating current $I_{comp}$ from the first input circuit path 1A. In this embodiment, by choosing an appropriate value of second resistor 116 the desired compensating current $I_{comp}$ can be drawn out of the first input circuit path 1A resulting in non variable current ratios across first input transistor 106 and first output transistor 110. Also, electronic circuits (100 and 200) may be implemented to achieve over-compensation, where the value of the collector current $I_{C1}$ decreases with the increase in the second supply voltage $V_2$ increases. For example, if the value of second resistor 116 is very low, the value of the compensation current $I_{comp}$ will be higher. Such high value of the compensation current $I_{comp}$, results in the over-compensation of the collector current $I_{C1}$. In contrast, very high value of second resistor 116 will result in the under-compensation of the collector current $I_{C1}$. Thus, an appropriate value of second resistor 116 should be chosen to achieve the desired level of the compensation.

The embodiments of the invention provide several advantages. Electronic circuits (100 and 200) are able to compensate or over compensate for changes in the second supply voltage $V_2$ by providing a constant bias point for first output transistor 110 and thus constant collector current $I_{C1}$. Electronic circuits (100 and 200) thus offer potential efficiency improvements, as well as better thermal control. In addition, by controlling the collector current $I_{C1}$, electronic circuits (100 and 200) are able to provide improved efficiency and linearity. Electronic circuits (100 and 200) provide advantages in low voltage operation as well. This is important in many applications such as wireless LAN and cellular power amplifiers, where the combination of low voltage and decreased collector current causes degradation in circuit linearity. Holding the collector current constant is extremely critical in the design of RF and microwave amplifiers. The ability to hold the current constant through bias control should result in a more optimum value of base ballasting, resulting in improved efficiency and linearity.

While various embodiments of the present invention have been illustrated and described, it will be clear that the electronic components (e.g., the transistors, resistors, and the impedance elements) of electronic circuits (100 and 200) can be fabricated as a single integrated circuit, or as discrete circuit components connected together (as shown in FIG. 1 or FIG. 2). Further, various other possible combinations of the electronic components may also be used without departing from the scope of the invention.

While various embodiments have been illustrated and described, it will be clear that the invention is not limited to these embodiments only. For a person having ordinary skill in the art, it will be apparent that numerous modifications, changes, variations, substitutions, and equivalents can be used without departing from the scope and spirit of the invention, as described in the claims that follow.

What is claimed is:

1. An electronic circuit comprising:

a first current mirror circuit having a first input circuit and a first output circuit, the first input circuit being operated at a first supply voltage and the first output circuit operated at a second supply voltage, the first input circuit including a first input transistor connected to a first voltage source and a first output transistor; and a second current mirror circuit having a second input circuit and a second output circuit, the second input circuit operated at the second supply voltage, and the second output circuit connected to the first input circuit, the second input circuit including a second input transistor connected to a second voltage source, the second output circuit including a second output transistor having a collector terminal connected to a collector terminal of the first input transistor, and a base terminal connected to a base terminal of the second input transistor, the collector terminal of the second output transistor connected to the first voltage source through a current control transistor, a gate terminal of the current control transistor connected directly to the collector terminal of the first input transistor, and a source terminal of the current control transistor connected to the collector terminal of the first input transistor through a first resistor.

2. The electronic circuit of claim 1 wherein the first input transistor is connected to the first voltage source through the first resistor.

3. The electronic circuit of claim 1 wherein the first output transistor is connected to the second voltage source through an inductive element.

4. The electronic circuit of claim 1 wherein the second voltage source differs from the first voltage source.

5. The electronic circuit of claim 1 wherein the current control transistor is a depletion mode field effect transistor.

6. The electronic circuit of claim 1 wherein the current control transistor operates at a pinch off voltage.

7. The electronic circuit of claim 1 wherein the current through the second output transistor compensates for variations in the current through the first output transistor.

8. The electronic circuit of claim 1 wherein the first current mirror circuit further includes the current control transistor.

9. An electronic circuit comprising:

a first current mirror circuit having a first input circuit and a first output circuit, the first input circuit being operated at a first supply voltage and the first output circuit operated at a second supply voltage, the first input circuit including a first input transistor and a first output transistor, the first input transistor connected to a first voltage source;

a second current mirror circuit having a second input circuit and a second output circuit, the second input circuit operated at the second supply voltage, and the second output circuit connected to the first input circuit, the second input circuit including a second input transistor connected to a second voltage source, the second output circuit including a second output transistor having a collector terminal connected to a collector terminal of the first input transistor, and a base terminal connected to a base terminal of the second input transistor; and an error transistor with a collector terminal connected to the second voltage source, and an emitter terminal connected to the base terminal of the first output transistor and the base terminal of the first input transistor.

10. The electronic circuit of claim 9 wherein the first input transistor is connected to the first voltage source through a first resistor.

11. The electronic circuit of claim 9 wherein the first output transistor is connected to the second voltage source through an inductive element.

12. The electronic circuit of claim 9 wherein the second voltage source differs from the first voltage source.

13. The electronic circuit of claim 9 wherein the first current mirror circuit further includes a current control transistor connected to the second output transistor.

14. The electronic circuit of claim 13 wherein the current control transistor operates at a pinch off voltage.

15. The electronic circuit of claim 13 wherein the current control transistor connects to the collector terminal of the first input transistor.

16. The electronic circuit of claim 13 wherein the error transistor converts a voltage at a source terminal of the current control transistor to an error signal.

17. The electronic circuit of claim 9 wherein the error transistor boosts a current supplied to a base terminal of the first input transistor.

18. The electronic circuit of claim 9 wherein the current through the second output transistor compensates for variations in the current through the first output transistor.

19. The electronic circuit of claim 9 wherein the second input transistor connects to the second voltage source through a second resistor.

20. An electronic circuit comprising:

a first current mirror circuit including a current control transistor, a first input transistor, a first output transistor, and an error transistor, the current control transistor connected to a first voltage source and connected to the first input transistor, a base terminal of the error transistor connected to a source terminal of the current control transistor, a collector terminal of the error transistor connected to a second voltage source, and an emitter terminal of the error transistor, a base terminal of the first input transistor, and a base terminal of the first output transistor being connected, and a collector terminal of the first output transistor connected to the second voltage source through an inductive element; and a second current mirror circuit including a second input transistor and a second output transistor, the second input transistor connected to the second voltage source through a resistor, the second output transistor connected to the source terminal of the current control transistor, and a base terminal of the second input transistor connected to a base terminal of the second output transistor.

* * * * *